United States Patent [19]

Greiner

[11] 4,253,715

[45] Mar. 3, 1981

[54] SEWING MACHINE CONSOLE HAVING A LOWERING DEVICE

[75] Inventor: Ulrich Greiner, Oberelchingen, Fed. Rep. of Germany

[73] Assignee: Pfaff Haushaltmaschinen GmbH, Fed. Rep. of Germany

[21] Appl. No.: 16,723

[22] Filed: Mar. 2, 1979

[30] Foreign Application Priority Data

Sep. 13, 1978 [DE] Fed. Rep. of Germany ..... 2839745

[51] Int. Cl.[3] ..... A47B 81/00; A47B 43/00

[52] U.S. Cl. ..... 312/21; 312/22; 312/24; 312/30; 312/258; 108/63; 112/217.1

[58] Field of Search ..... 312/21, 22, 23, 24, 312/25, 26, 27, 28, 29, 30, 237, 250, 258; 112/217.1; 108/63

[56] References Cited

U.S. PATENT DOCUMENTS

| | | | |
|---|---|---|---|
| Re. 28,835 | 6/1976 | Roberts et al. | 312/29 |
| 1,408,731 | 3/1922 | Harris | 312/237 |
| 1,889,760 | 12/1932 | Peters | 312/258 |
| 2,103,091 | 12/1937 | Robert | 312/30 |
| 2,574,769 | 11/1951 | Thomas | 312/237 |
| 2,953,244 | 9/1960 | Phillips | 108/63 |
| 3,087,767 | 4/1963 | Schell | 312/250 |
| 3,120,076 | 2/1964 | Zuch | 312/258 |
| 3,707,316 | 12/1972 | Mark | 312/21 |
| 4,005,918 | 2/1977 | Smith et al. | 312/30 |
| 4,056,294 | 11/1977 | Godlewski et al. | 312/21 |
| 4,089,572 | 5/1978 | Flynt et al. | 312/27 |
| 4,108,512 | 8/1978 | White | 312/24 |
| 4,123,124 | 10/1978 | Peets | 312/21 |
| 4,132,295 | 1/1979 | Hochfelsen | 312/24 |

FOREIGN PATENT DOCUMENTS

| | | | |
|---|---|---|---|
| 990296 | 9/1951 | France | 312/28 |

*Primary Examiner*—Victor N. Sakran
*Attorney, Agent, or Firm*—McGlew and Tuttle

[57] ABSTRACT

A console for a sewing machine comprises a supporting base which includes a rear wall with respective opposite sidewalls and a front wall hinged to one side wall which is openable and is provided with a cover at right angles to the upper edge thereof so that it forms in an open position a fabric support table. A carrier, including a plate portion which has a top surface for supporting the sewing machine and a back support is connected to the rear wall of the supporting base. The back support includes the lower part engaged with the supporting base and an upper part which is hinged to the lower part which is connected to the carrier to support the carrier in an operative position above the supporting base. In addition, a stirrup has a central portion pivotally connected to the carrier plate and a lower portion which is guided in slots in each side wall. The carrier in the upper position of the slot supports the carrier plate with the sewing machine in an operative position. When it is moved downwardly in the associated slot the carrier plate may pivot together with back support portion so as to orient the sewing machine with the carrier plate downwardly and into the interior of the supporting base.

5 Claims, 3 Drawing Figures

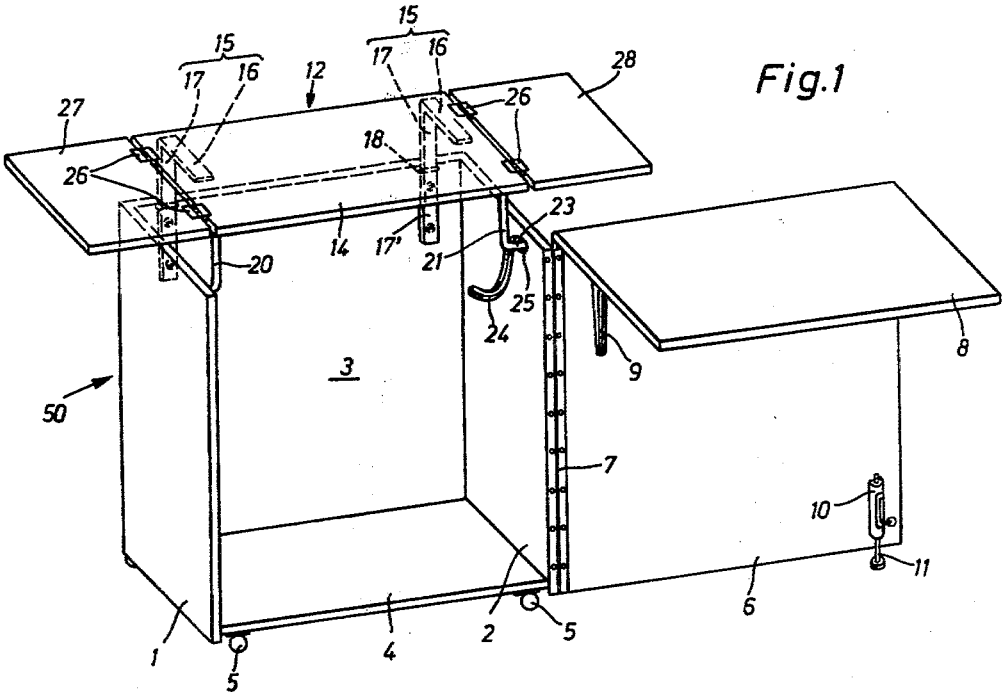
Fig.1
Fig.2
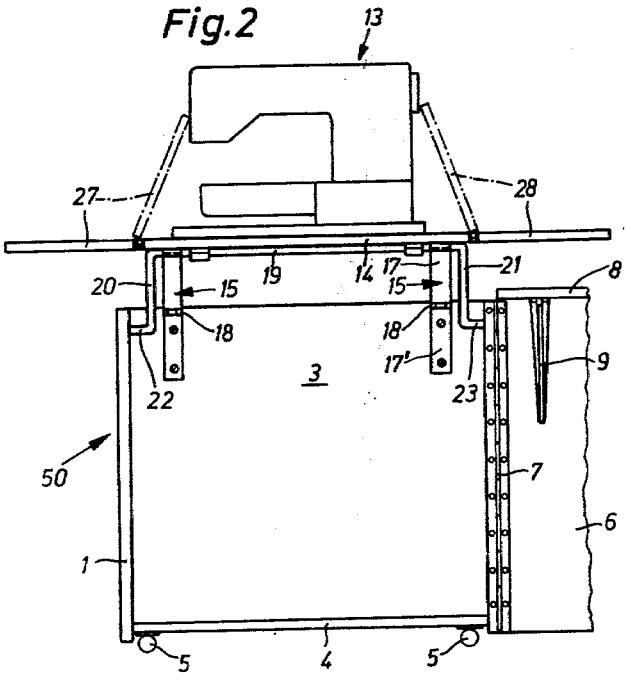
Fig.3
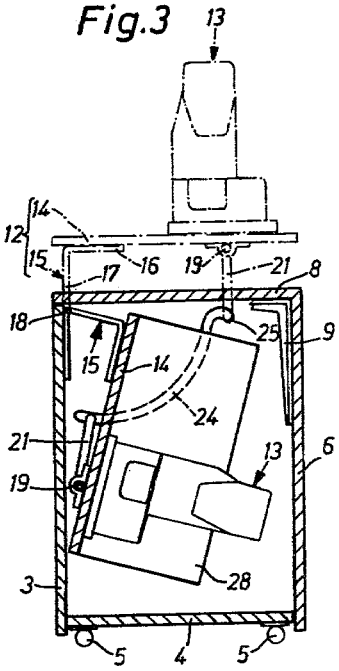

SEWING MACHINE CONSOLE HAVING A LOWERING DEVICE

BACKGROUND OF THE INVENTION

1. Field of the Invention

This invention relates in general to the construction of sewing machine accessories, and in particular to a new and useful console for a sewing machine which includes a carrier for supporting the sewing machine which may be swung between an operative position in which the carrier plate portion is positioned over the supporting base and a lower position in which the plate portion is disposed within the supporting base.

2. Description of the Prior Art

Support cabinets or consoles for sewing machines should have ergonomically favorable working height when in use, determined on the basis of present experience, with enough leg room for the user, a sufficiently large table surface as a working surface for easy handling of the sewing material, and also should be equipped with a place for depositing the sewing material and for accessories required for sewing. When not in use, the console should be foldable to small dimensions and require as little space as possible so that it can be put away and stored inconspicuously.

In the known consoles with a lowering device, these requirements can only be met with considerable expenditures and they are not completely satisfactory. Particularly the requirement of providing the console with a low height for putting it away and the carrier of the sewing machine with the correct working height when in a sewing position, presented considerable difficulties and led to the development of partly complicated dropping devices which are not always simple to handle.

SUMMARY OF THE INVENTION

In accordance with the invention, there is provided a console for a sewing machine which overcomes the disadvantages of the prior art construction and includes a supporting base having bottom, rear and side walls which form a portion of a storage cabinet with a front wall hinged to the side wall which has a top cover connected thereto at right angles and which will form a cover for the cabinet when the carrier for the sewing machine is in position. In accordance with the invention, the carrier for supporting the sewing machine includes a plate portion with a top surface in which the sewing machine is adapted to rest and a back support which includes a lower part engaged with the supporting base and an upper part pivoted to the lower part which is connected to the plate portion. In addition, a stirrup is pivotally connected at a central portion to the carrier plate portion as side portions which extend downwardly and engage into stirrup guide means in the form of a slot at each side wall of the cabinet supporting base. The stirrup guide means are such that the stirrup may be swung downwardly in the guide to move the plate portion from a horizontal position spaced above the support base for operation of the sewing machine to a stowed position in which the plate portion of the carrier may be positioned within the supporting base with the sewing machine and in which upper part of the back portion of the carrier is pivoted downwardly from the lower part.

Accordingly, it is an object of the invention to provide a console for a sewing machine which comprises a supporting base having stirrup guide means and having an open top and including a carrier with a plate portion having a top surface for supporting the sewing machine and a back support with a lower part engaged with the supporting base and an upward part pivoted to the lower part and connected to the plate portion and further including a stirrup having a portion engaged with the carrier and a portion engaged with the stirrup guide means wherein the sewing machine may be positioned on the carrier at a spaced location above the supporting base and pivoted downwardly into the carrier for stowing.

A further object of the invention is to provide a console for a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the Drawings:

FIG. 1 is a front top perspective view of a console for a sewing machine in an operative position constructed in accordance with the invention;

FIG. 2 is a side elevation of the console with a sewing machine thereon in an operative position; and FIG. 3 is a transverse sectional view of the console in the non-operative position.

GENERAL DESCRIPTION OF THE PREFERRED EMBODIMENT

Referring to the drawings in particular, the invention embodied therein comprises a console or cabinet generally designated 50 for supporting a sewing machine both in an operative position as shown in FIG. 2, and in a stowed position as shown in FIG. 3. Console 50 comprises a supporting base forming a cabinet with a rear wall 3, side walls 1 and 2 and a front wall 6 leaving an open top which is closed by a cover 8. Carrier member generally designated 12 has a plate portion 14 with a top surface providing a support for a sewing machine 13. In addition, the carrier includes a back portion or back support 15 which in the embodiment shown comprises angle members with sides 16 and 17. The side 16 is connected to the carrier plate portion 14 and the side 17 includes a lower part 17' to secure to the back or rear wall 3 of the supporting base. The rear portion 17 of the angle member includes a hinge 18 located at about the top of the rear wall to permit pivoting of the upper part 17 relative to the lower part 17'. The supporting base also carries stirrup guide means in the form of a slot 24 in each wall 1 and 2, and a stirrup 19 has a top portion engaged with the carrier 14 and a portion engaged with the stirrup guide means 24.

The console supporting base has two side walls 1 and 2, and a rear wall 3 and a bottom 4. On the underside of the bottom are secured four casters 5. On the front edge of one side wall (2) is hinged a door 6 by means of a hinge 7. Door 6 is joined in a right angle with a cover 8 and forms together with it a rigid unit. Two angle struts 9 (one only is shown) serve to reinforce the door 6 and cover 8. Close to the edge of the door 6 opposite hinge 7 is arranged a support 11, which can be displaced longitudinally and locked in a sleeve 10, to support the unit consisting of door 6 and cover plate 8. In operating position, shown in FIGS. 1 and 2, cover 8 of the unit forms a table for depositing the sewing material and for the accessories necessary for sewing.

A carrier 12 for a sewing machine 13 is formed by two carrier elements 14 and 15 which are joined with each other in an angle so that the carrier 12 has an angular cross section comprising a plate attachment 14 and a bracket carrier element 15. In the represented embodiment, one carrier element (14), on which sewing machine 13 can be screwed or secured in any other way, is a plate, while the other carrier element (15) is formed by two supporting angles with sides 16, 17, which are secured with one side (16) on plate 14 and jointed at 18 with the other side (17) on the rear edge of rear wall 14 and between the two side walls 1 and 2, so that the console is open at the front when the console is in use. Sides 17 of carrier 12 form in an operating position an extension of the console rear wall 3. The side 17 of carrier element 5 is provided with a swivel axis (18) or hinge for pivoting the carrier 12.

Instead of the two supporting angles 15 as the second arm of carrier 12, a continuous plate joined angularly with plate 14 could be used.

For supporting carrier 12 with sewing machine 13 in operating position, a stirrup 19 comprising a bar with bent-off ends 20 and 21 is pivotally mounted on the underside of the free end of plate 14 carrying sewing machine 13, with outwardly directed guide pins 22 and 23 respectively provided at the ends 20 and 21. These guide pins 22, 23 protrude into retaining slots 24 in each wall 1 and 2 (only one is shown in FIGS. 1 and 3), which are provided in side walls 1 and 2.

The upper part of retaining slots 24 forms in the operating position of carrier 12 with sewing machine 13 a catch for guide pins 22, 23 of bar 19.

In order to have a sufficiently large table surface available for handling the sewing material, an extension plate 27 and an extension plate 25 are hinged by hinges 26 and 26' to respective lateral edges of the sewing machine carrying the plate-shaped arm 14 of of carrier 12.

The operation of the device is as follows:

Starting with the position shown in FIG. 2 with the sewing machine 13 disposed on the carrier plate portion 14 and secured thereto by suitable means, the extensions 27 and 28 are raised from the solid line position shown into the dotted line position. In addition, the support 11, which is shown only in FIG. 1, is moved upwardly to release it from engagement with the ground so as to permit the front door 6 to be swung backwardly to close the console. Before the console is closed, the stirrup 19 is swung so that its engagement in the slot is moved downwardly along the walls of the console so as to cause a downswinging of the plate portion with the sewing machine to position the sewing machine in an oblique position within the cabinet. Thereafter, when the front door 6 is closed, the cover 8 overlies the sewing machine and closes the cabinet. In the non-use state, the console takes up relatively little space. It can be easily moved on the casters 5 and be put away inconspicuously due to its small dimensions, for example as a part of a larger piece of furniture.

In order to prepare the console and the sewing machine for sewing, the unit comprising door 6 and cover 8 is turned by 180° about hinge 7 into the position shown in FIGS. 1 and 2, in which cover 8 can be used as a deposit table. Then the plate forming arm 14 of carrier 12 is raised with sewing machine 13 and extensions 27, 28 about swivel axis 18 into the operating position indicated in FIG. 2 by solid lines and in FIG. 3 by broken lines, to a working height determined by the length of the side 17 of carrier 12, which exceeds the height of the console in its non-use position. In operating position guide pins 22, 23 engage the upper part 25 of retaining slots 24. After folding down the extensions 27 and 28 into their horizontal position, the sewing machine and the console are ready to use. If the console is to be brought into the non-use position, the order is reversed.

While a specific embodiment of the invention has been shown and described in detail to illustrate the application of the principles of the invention, it will be understood that the invention may be embodied otherwise without departing from such principles.

What is claimed is:

1. A console for a sewing machine comprising a supporting base having side walls and a hollow receiving portion, stirrup guide means defined within the hollow receiving portion, said base having an open top opening into the hollow receiving portion, a carrier including a plate portion having a top surface for supporting the sewing machine and a back support with a lower part engaged with said supporting base and an upper part pivoted to said lower part and connected to said plate portion, a stirrup having a portion engaged with said carrier a portion engaged with said stirrup guide means and being tiltable as guided by said stirrup guide means to move said plate portion between a substantially horizontal position above the top of said supporting base and above the hollow interior of said supporting base and a stowed position disposed obliquely within said hollow receiving portion, said upper part of said back support extending above the top of said supporting base with said plate portion in the horizontal position, wherein said stirrup guide means includes a substantially U-shaped member having a first straight arm portion engaged beneath said plate portion and outwardly extending arm portions on each side, each having a bent-off end, said stirrup guide means comprising a slot defined in the hollow interior of said supporting base with the bent-off ends of said stirrup being engaged in said slot.

2. A console according to claim 1 wherein said back support comprises a first angle portion engaged with said carrier plate portion forming said upper part, and a second member comprising said lower part.

3. A console according to claim 1 including a front door portion pivotally connected to one of said side walls and adapted to be pivoted into a position closing said hollow interior and a cover portion secured to said front door portion and adapted to close and cover the opening of said hollow interior when the door is in a closed position.

4. A console according to claim 1 including an extension plate pivoted to said plate portion on at least one end thereof, said plate being adapted to extend beyond the width of the hollow interior of said support base in an operative position but being foldable upwardly to permit insertion thereof into said hollow receiving portion.

5. A console according to claim 2, wherein said U-shaped member of said stirrup is pivotally mounted beneath said plate portion, said slot having a lower long curved portion concave to said plate portion in its horizontal position and an upper short curved portion convex to said plate portion in its horizontal position, said bent off ends of said stirrup being engaged in said upper short curved portion of said slot with said plate portion in its horizontal position.

* * * * *